US005656378A

United States Patent [19]

Lambert

[11] Patent Number: 5,656,378

[45] **Date of Patent: *Aug. 12, 1997**

[54] INK ACCEPTOR MATERIAL CONTAINING AN AMINO COMPOUND

[75] Inventor: Ronald Frederick Lambert, Wayland, Mass.

[73] Assignee: Labelon Corporation, Canandaigua, N.Y.

[ * ] Notice: The term of this patent shall not extend beyond the expiration date of Pat. No. 5,474,843.

[21] Appl. No.: 168,849

[22] Filed: Dec. 16, 1993

[51] Int. Cl.[6] ..... B41J 2/01

[52] U.S. Cl. ..... 428/478.2; 347/105; 428/145; 428/211; 428/478.8

[58] Field of Search ..... 428/195, 327, 428/447, 478.2, 478.8, 211; 347/105

[56] References Cited

U.S. PATENT DOCUMENTS

| | | | |
|---|---|---|---|
| 4,371,582 | 2/1983 | Sugryama et al. | 428/341 |
| 4,379,804 | 4/1983 | Eisele et al. | 428/332 |
| 4,381,185 | 4/1983 | Swanson et al. | 8/506 |
| 4,547,405 | 10/1985 | Bedell et al. | 428/323 |
| 4,554,181 | 11/1985 | Cousins et al. | 428/211 |
| 4,575,465 | 3/1986 | Viola | 428/195 |
| 4,578,285 | 3/1986 | Viola | 428/331 |
| 4,785,313 | 11/1988 | Higuma et al. | 346/1.1 |
| 4,857,386 | 8/1989 | Butters et al. | 428/206 |
| 4,877,680 | 10/1989 | Sakaki et al. | 428/332 |
| 4,935,307 | 6/1990 | Iqbal et al. | 428/500 |
| 4,944,988 | 7/1990 | Yasuda et al. | 428/195 |
| 5,023,129 | 6/1991 | Morganti et al. | 428/195 |
| 5,180,425 | 1/1993 | Matrick et al. | 106/22 R |
| 5,180,624 | 1/1993 | Kojima et al. | 428/211 |
| 5,183,502 | 2/1993 | Meichsnër et al. | 106/20 D |
| 5,190,805 | 3/1993 | Atherton et al. | 428/195 |
| 5,192,617 | 3/1993 | Stofko et al. | 428/411.1 |
| 5,206,071 | 4/1993 | Atherton et al. | 428/195 |
| 5,219,928 | 6/1993 | Stofko, Jr. et al. | 428/331 |
| 5,223,338 | 6/1993 | Malhotra | 428/195 |
| 5,284,815 | 2/1994 | Uytterhoeven et al. | 503/227 |
| 5,302,436 | 4/1994 | Miller | 428/195 |
| 5,310,595 | 5/1994 | Ali et al. | 428/206 |
| 5,342,688 | 8/1994 | Kitchin et al. | 428/195 |
| 5,354,813 | 10/1994 | Farooq et al. | 525/326.7 |
| 5,451,466 | 9/1995 | Malhotra | 428/195 |

FOREIGN PATENT DOCUMENTS

| | | | |
|---|---|---|---|
| 0 484 016 A1 | 10/1991 | European Pat. Off. | 428/195 |
| WO92/07722 | 5/1992 | WIPO | 428/195 |

OTHER PUBLICATIONS

"The Theory of the Photographic Process," Macmillan Publishing Co., Inc., New York, Fourth Edition, T.H. James, Editor; (see Chapter III, pp. 77–87, by Burness and Pouradier, entitled The Hardening of Gelatin and Emulsions).

Esprit Chemical Co. brochure "MR Series" published prior to Dec. 16, 1993.

*Primary Examiner*—Pamela R. Schwartz

*Attorney, Agent, or Firm*—Nixon, Hargrave, Devans & Doyle

[57] ABSTRACT

An acceptor material for printing by ink-jet printers forms water-resistant, light-stable ink records with aqueous ink jet inks. The material comprises a support such as polyester film and a coating containing a water-soluble high molecular weight amino compound that forms insoluble compounds with and immobilizes the dyestuffs of the ink jet inks and a water managing polymer, preferably, hardened gelatin, which quickly renders the material dry-to-the-touch after contact with the aqueous ink.

16 Claims, 2 Drawing Sheets

INK ACCEPTOR MATERIAL CONTAINING AN AMINO COMPOUND

RELATED APPLICATIONS

Reference is made to the concurrently filed and commonly owned U.S. Pat. No. 5,474,843 of Ronald F. Lambert and Edward J. Johnson entitled "Acceptor Material for Inks" and patent application No. 08/168,467, now abandoned in favor of continuing application No. 08/658,395 of Ronald F. Lambert entitled "Ink Acceptor Material Containing a Phospholipid".

FIELD OF THE INVENTION

This invention relates to an acceptor material for ink printing and, more particularly, to a coated acceptor material for forming water-resistant, light-stable ink records with ink jet inks.

BACKGROUND OF THE INVENTION

Ink jet printing is a non-impact means of producing a pattern of ink droplets which can be used to record digital information. To make a hard copy, the droplets are deposited onto a transparent, translucent, or opaque support such as film, vellum or paper. Ink jet printers have been used for many years to make monochrome hard copy from computers. A rapidly-growing use of ink jet printers is to generate subtractive color images using a three- or four-color process. The resultant hard copy can be viewed by transmitted light using an overhead projector (transparent film); by transmitted light using a diffuse illuminator (translucent film); or by reflected light (opaque support).

In subtractive continuous tone silver halide color photography, color images are produced by the superposition of three primary continuous-tone color-intensity-graduated recording layers. In non-continuous tone ink jet color printing, use is made of microscopic superposed color-separated dots (so-called halftone images) to create an impression to the viewer of an intensity graduated image. The proper hue, size, and degree of coalescence and mixing of the primary color dots—cyan, magenta, yellow and black—are necessary for the faithful reproduction of color on the recording medium. Accurate ink jet color image recording thus requires a high degree of cooperation between the ink jet color separation pulses, the ink dyestuffs, and the ink acceptor material.

An ink acceptor material should be capable of accepting the droplets readily and allowing them to coalesce, yet should achieve color isolation and separation with high chroma and pure hue without image edge distortions due to poor registration, bleeding, leathering, or other image quality defects. Acceptor materials for colored inks currently available, however, suffer from rapid fading of one or more of the dyestuffs upon exposure to light, heat, or high humidity storage conditions. Furthermore, inked acceptor materials are not water-resistant, and images thereon can be degraded easily by handling or by contact with moist objects. Fingers and other moist objects contacting the images often become stained with the dyestuffs. Also, because the usual aqueous ink jet inks have relatively low volatility, imaged acceptor materials are typically still wet with the aqueous ink vehicle when emerging from an ink jet printer. Images are then most vulnerable and can be altered by smudging or blocking (print stacking). Thus, there is a need for an ink acceptor material capable of rendering ink jet images which dry rapidly, are resistant to adverse effects of fingerprints, handling, high humidity storage, water spills, and the like, and which show a high degree of stability to light. Such attributes will be highly useful in extending ink jet imaging to, for example, mail addressing, airline tickets, outdoor advertising displays, T-shirt printing, and posters-on-demand type applications.

SUMMARY OF THE INVENTION

The acceptor materials of the invention are useful particularly as receivers for thermal ink jet printing (bubble jet) or for non-thermal printing with inks comprising an aqueous vehicle and ionic, water-soluble, colored dyes, such as inks disclosed in U.S. Pat. Nos. 5,180,425 and 5,183,502 which are incorporated herein by reference. In general, however, they are useful in any process for printing information or images with such aqueous inks, including not only ink jet but also offset printing, gravure printing and the like. Using these inks, of which the dyestuffs typically contain anionic groups, the acceptor materials of the invention can provide images of high quality, which are resistant to smearing and have excellent light stability. The ink acceptor materials of the invention are especially characterized by rapid drying, a quality of major importance in ink jet printing because of the high liquid content of the ink composition and the vulnerability of the freshly deposited wet images.

Acceptor materials of the invention function by independent management of the ionic ink jet dyestuffs and the aqueous ink vehicle. A water-soluble amino compound mordant reacts with and immobilizes the dyestuffs by forming a water-insoluble compound or coacervate while a solid water-absorbing polymer simultaneously wicks away the ink vehicle from the surface of the acceptor material. The mordant thereby controls the dye deposition process, and directs the dye movement (locus of dots) within the acceptor material to provide dot separation and coalescence-registration, thus maximizing the close-packing and permanence of the dyestuffs. The water-absorbent matrix polymer controls the large volume of aqueous ink vehicle (for most aqueous inks, 70–90% of the composition) thus causing a rapid dry-to-the-touch, non-tacky response of the acceptor material with minimal dot spreading and no blocking or smudging of the image. The result is a superior, full color ink jet image having excellent chroma and image resolution.

As disclosed in the concurrently filed patent application of Lambert and Johnson entitled "Acceptor Material for Inks", certain water-soluble polymeric quaternary ammonium compounds and electropositive metal ions are useful mordant materials for ionically bonding with the anionic dyestuffs of ink jet aqueous inks. These ionic mordants serve as dye management components in ink acceptor materials which contain chemically prehardened polymers as water management components. The ink acceptor materials of the present invention contain another class of dye management components that anchor and immobilize the anionic dyes of ink jet aqueous inks. The dye management components in the acceptor materials of the present invention are high molecular weight amino compounds that are water-soluble at room temperature.

The invention includes an acceptor material for inks, which inks contain ionic dyestuffs and an aqueous liquid vehicle. Said acceptor material comprises a support and coated on the support, an ink-accepting composition comprising (a) a water-soluble high molecular weight amino compound which, when admixed in excess with such an ionic dyestuff in aqueous solution at room temperature, forms a water-insoluble precipitate and a clear, substantially colorless supernatant liquid, and (b) a water-absorbing, solid polymer, wherein said polymer is non-reactive with and permeable by said ionic dyestuffs. The mordant and water absorbing polymer can be in separate layers on the support but, in a preferred embodiment they are in the same layer.

The invention further includes a novel imaged ink jet acceptor sheet which comprises a support and, on said support, a layer containing hardened gelatin and, dispersed therein, a water insoluble coacervate of a water soluble high molecular weight amino compound and a water soluble ionic dye compound.

DETAILED DESCRIPTION OF THE INVENTION

Figure 1:
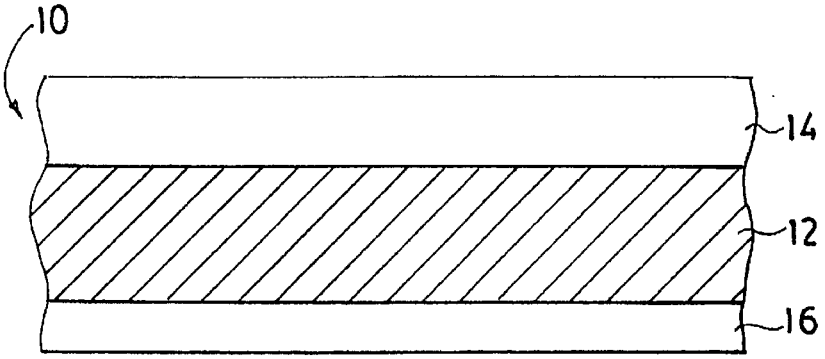
FIG. 1 shows a cross-section of an ink acceptor sheet of the invention in which the support is coated on one side with the ink receiving composition and on the other side with a static, curl control, matte or other functional layer.

The ink acceptor material of the invention provides diffusion management of the deposited wet ink dots, the dyestuffs therein, and the liquid vehicle of the soluble dyes. Surprisingly, the applicants have found that certain water-soluble, high molecular weight amino compounds, such as those disclosed hereinafter, are effective mordants or dye-immobilizing compounds for ionic dyestuffs as commonly used in ink jet inks and other printing inks.

The ink acceptor materials of the invention are prepared by coating and drying on a transparent, translucent or opaque sheet or web a layer or layers of the appropriate compositions. In the preferred embodiment an aqueous coating composition is formed which contains both a water-absorbing polymer and an amino compound mordant. In addition the composition, preferably contains a hardening agent for the water-absorbing polymer, a coating aid and particulate addenda to improve handling and/or sheet feeding properties of the ultimate sheet material. The coated layer is dried to form a thin layer in which the mordant is uniformly distributed throughout the water-absorbing polymer matrix. The total thickness of the dried ink receiving composition on the support, whether coated as one or a plurality of layers, is preferably in the range from about 1 to 25 μm (although greater thicknesses can be used), and most preferably is in the range from about 2 to 18 μm.

Amino mordant compounds which pass the screening test described hereinafter and are useful as mordants in the materials of the invention, but which anchor the ionic dyestuffs of ink jet aqueous inks by mechanisms that are not understood, are high molecular weight (i.e., at least about 400 number average m.w.) primary, secondary and tertiary amines. These include water-soluble, non-ionic polymers containing amine groups, for example, poly(4-vinylpyridine) which is available from Monomer Polymer Company. Other examples include the non-ionic propylene oxide based triamines of the Jeffamine T series which are available from Texaco, Inc. They are prepared by the reaction of propylene oxide with an aliphatic triol initiator having up to about 12 carbon atoms, such as trimethylolpropane or glycerine, followed by amination of the terminal hydroxyl groups. These tri-primary amines are exemplified by the structure:

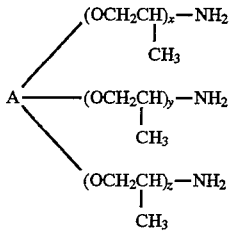

wherein A is the hydrocarbon residue of the initiator. Number-average molecular weights range from about 440 to about 5000; x, y and z are each positive integers and x+y+z=3 to about 85.

Preferred examples of such tri-primary animes of the Jeffamine T series include Jeffamine T-403 in which the aliphatic triol is trimethylolpropane, the approximate number-average molecular weight is 440 and x+y+z is approximately 5 to 6; Jeffamine T-3000 in which the aliphatic triol is glycerine, the approximate number-average molecular weight is 3000 and x+y+z is approximately 50; and Jeffamine T-5000 in which the aliphatic triol is glycerine, the approximate number-average molecular weight is 5000 and x+y+z is approximately 85.

Although the above-noted water-soluble amino compounds are non-ionic, they form water-insoluble reaction products with the anionic dyes of aqueous ink jet inks and are useful as mordants in accordance with the present invention.

The water-absorbing polymer employed in the material of the invention has no affinity for the water-soluble ink jet dyes and therefore allows rapid diffusion of said dyes within the ink acceptor material, wherein said dyes are rapidly immobilized by chemical reaction with the water-soluble amino compound mordant to form a non-diffusing compound or coacervate. As indicated, the amino compound can be distributed uniformly throughout the water absorbing matrix polymer or can be mixed with a portion of the water-absorbing polymer and coated in a separate layer above or below the water absorbing layer. Although the applicant does not wish to be bound by theoretical explanations, it appears that a high percentage of the dyestuff reacts with mordant and is immobilized when the mordant is distributed throughout the water-absorbing or wicking polymer or is coated over it. The high optical density which characterizes the images formed by the acceptor materials of the invention appears to result from the high concentration of mobilized dye or coacervate caused by the unexpected reactivity of the ink jet dyes with the amino compounds described herein.

Although the ink jet inks with which the ink accepting materials of the invention provide such outstanding results, are aqueous inks, it should be understood that, in addition to water, the ink vehicle can also include hydrophilic organic liquids. In general, the water content of the aqueous vehicle of the inks is in the range from about 30 to 99 weight percent, and preferably 70 to 90 weight percent, the rest being hydrophilic organic liquids such as glycols, glycol ethers, pyrrolidones and surfactants. As is known, such hydrophilic liquids can aid in the delivery of the inks by ink jet printers.

Referring to the drawings, FIG. 1 shows a preferred embodiment 10 of an acceptor material of the invention comprising support 12 and, coated on it, ink acceptor composition 14. Support 12 is a sheet material which can be transparent, translucent, or opaque. Useful opaque sheet materials include paper, opaque filled polyester, polyethylene-clad paper, white polypropylene film and the like. Useful transparent or translucent materials include, for example, poly(ethylene terephthalate), cellulose acetate, polycarbonate, polyolefin, polyvinyl chloride, polystyrene, polysulfone, styrene acrylonitrile (also known as SAN), glass and the like. Support 12 can be coated with a conventional tie or subbing layer (not shown) to enhance adhesion of composition 14 to support 12, as well as one or more backing layers 16 to control physical properties such as static, blocking, curl or color.

Ink acceptor composition 14 comprises a water-absorbing polymer, preferably a hardened polymer such as hardened gelatin. Upon being coated and dried, the polymer forms a matrix which is transparent to light, is insoluble in water at room temperature, and is resistant to abrasion. The polymer, however, retains its hydrophilic character, is easily swollen by water, is easily permeated by the aqueous ink vehicle and by water soluble dyestuffs, and has no chemical affinity for said dyestuffs. Hardenable polymers suitable for this purpose other than gelatin include, for example, chitosan, starch, agarose, albumen, casein, and gum arabic. Hardenable synthetic materials include, for example, hydroxy propyl cellulose (e.g., Klucel polymer of Hercules Corp.), carboxylated styrenebutadiene lattices, poly(acrylic acid), poly(methylvinylether-co-maleic anhydride), e.g., Gantrez 169 polymer, poly(vinyl alcohol) and poly(N-vinyl-4-pyrrolidone). Examples of other water-absorbing polymers which can be used with amino compound mordants in accordance with the invention include aqueous liquid absorbing polymers disclosed in U.S. Pat. Nos. 5,192,617; 5,219,928; 4,379,804 and 5,180,624; and in International Patent Application PCT/US91/06686, International Publication Number WO92/07722. The water-absorbing polymer can also have dispersed therein, as disclosed in the above cited, concurrently filed Lambert and Johnson patent application, polymer beads such as crosslinked poly(methyl methacrylate) beads or poly(dimethyl siloxane) beads of 3 to 15 μm diameter. The disclosures of these cited patents and applications are incorporated herein by reference.

Composition 14 further includes the water-soluble mordant or dye-fixing agent, which is a water-soluble amino compound that is capable of bonding with the anionic dyestuffs in ink jet inks, to form a water-insoluble, mobile or "coacervate" compound in the acceptor matrix without any significant change in the chroma or hue of the original dyestuffs. Preferably, the mordant is distributed uniformly throughout the water-absorbing polymer of composition 14.

By water-soluble amino compound is meant an amino compound capable of dissolving in water at room temperature (20° C.) to a concentration of at least a 10 gm/liter. Preferably, the amino compound is water soluble to at least 30 gm/liter at room temperature.

The amino compound in the ink acceptor materials of the invention bond to and anchor the dyes by mechanisms that are not fully understood. They all have in common, however, the fact that, when tested in the screening tests described hereinafter, they rapidly form precipitates with the dye when mixed therewith in aqueous solution at room temperature.

All water-soluble amino compounds which pass the screening test A below are suitable as mordants in the materials of the invention for bonding to and immobilizing the anionic dyestuffs of ink jet inks. The selection of suitable mordants can be facilitated by the simple screening test in which an aqueous solution of an anionic dyestuff which is present in the aqueous ink jet ink is added at room temperature (20° C.) to an aqueous solution of the amino compound. The rapid formation of a coacervate or precipitate, which can be an oil or a solid, and a clear, substantially colorless supernatant liquid indicates the suitability of the amino compound for use as a mordant in the ink acceptor materials of the invention. The screening procedure is illustrated as follows:

Coacervation Screening Test A—Add dyestuff to mordant solution.

Poly (4-Vinylpyridine) Test:

1000 picoliters of 5% magenta dyestuff in water is added at room temperature to 20 mg of poly (4-vinylpyridine) in 2 ml of water. A gelatinous red precipitate forms. The supernatant liquid is clear.

Poly(N-vinyl-4-pyrrolidone) Test:

In the same manner the magenta dyestuff solution is added to an aqueous solution of poly(N-vinyl-4-pyrrolidone). No precipitate forms and the liquid is colored.

As shown above, the amino compound, poly(4-vinylpyridine) passes the screening test as a useful mordant but poly (N-vinyl-4-pyrrolidone) does not.

Test A is the preferred method for selecting and defining the mordants that are used in the acceptor materials of the invention. In this test, the mordant candidate is in a molecular excess. The suitability of the mordant is demonstrated by the rapid formation of a solid or oil precipitate and by the fact that the supernatant liquid remains clear and substantially uncolored, thus showing that substantially all of the dye has been mordanted or converted to the insoluble precipate or coacervate.

Test B below is another possible screening test for mordants. This test reflects what the early and late stages of ink imaging are like. In this test an aqueous solution of the candidate mordant is added to an aqueous solution of the ink jet anionic dyestuff present in molecular excess with which images are to be formed. Since the dyestuff is in excess, the supernatant liquid is colored. If the mordant candidate is suitable, then it forms an insoluble precipitate or oil immediately or immediately gives a turbid suspension which can be centrifuged to obtain a precipitate or oil. Thus either Test A or Test B can be used but Test A is preferred as a method for defining the suitable mordants because Test A rapidly shows that the dye reacts with the mordant and also that little or none is in solution in the supernatant liquid.

Coacervation Screening Test B—Add mordant to dyestuff solution.

Amino Compound Test:

To one ml of 5% magenta dyestuff aqueous solution is added 1000 picoliters of 5% aqueous solution of poly(4-vinylpyridine). A heavy precipitate forms immediately.

Poly(N-vinyl-4-pyrrolidone) Test:

In the same manner an aqueous solution of poly(N-vinyl-4-pyrrolidone) is added to the aqueous solution of dyestuff. No reaction occurs.

These screening tests show the rapid formation of a water-insoluble coacervate when poly(4-vinylpyridine) is mixed with the water-soluble, anionic magenta dyestuff solution and shows that this polymeric amine is suitable as a mordant in the ink acceptor materials of the invention. Poly(N-vinyl-4-pyrrolidone), however, forms no insoluble coacervate with the dyestuff and would not be selected as a mordant component of the materials of the invention.

Surface gloss of the composite acceptor materials of the invention can be controlled by choice of mordant. Applicant has found that acceptor materials of the invention having a glossy surface (which is desirable for some purposes) are obtained when the mordant is a high molecular weight amino compound.

The acceptor material of the invention accepts the ink dots cleanly and allows sufficient coalescence time to achieve good dot registration, yet permits penetration of the inks to achieve proper hue and chroma. At the moment of contact, the ink vehicle begins to diffuse into the ink-accepting layer, increasing the concentration of dyestuff in the applied droplets on the surface. The ionic colored dyes also begin to diffuse into the material where they are captured and bound irreversibly by the mordant which, in the preferred embodiment of the invention, is distributed uniformly throughout the ink-accepting layer. The high molecular weight amino compound surprisingly has a high affinity for the anionic dyestuffs and is present in such concentration that the dyes are mordanted preferentially on the surface sites of the mordant component. The swelling matrix polymer promotes dye diffusivity lower in the layer and allows fresh mordant sites to migrate toward the penetrating dyes where they react readily with the diffusing dyestuffs, thereby mordanting preferentially a high percentage of the dyestuffs in the upper portion of the coated layer. This coacervate formation causes each colored dye dot to be fixed in registration with good edge definition onto these functional sites, and the image quality of the digital signal is thus preserved. Also, the high concentration of dyestuff results in a high chroma (or color saturation) and efficient packing density of the dyes.

The vehicle for the dyes is wicked away from the uppermost surface rapidly by the hydrophilic water-absorbing polymer of the acceptor material. In effect, the coated layer performs a chromatographic separation of the ink composition, retaining the dyes on the active mordant surface sites while permitting the liquid vehicle to diffuse readily to the unswelled portion of the polymer. This combination of actions results in high chroma, good light stability, water fastness, and short drying times.

Figure 2:
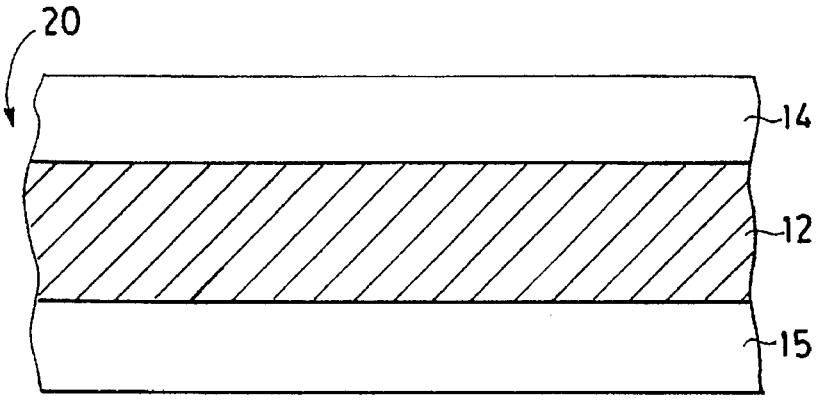
FIG. 2 shows a cross-section of an ink acceptor sheet of the invention in which the support is coated on two sides with ink receiving compositions.

FIG. 2 shows another embodiment 20 of the invention wherein support 12 is coated on both sides with ink accepting compositions 14 and 15, which can be the same or different, and which can be coated to the same or different thicknesses. The embodiments of FIGS. 1 and 2 can further include one or more protective overcoats (not shown) on top of ink-accepting layers 14 and 15.

Figure 3:
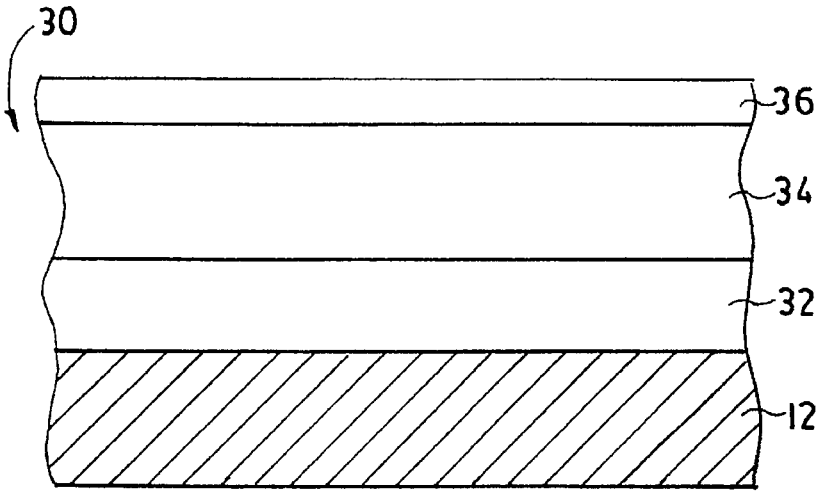
FIG. 3 shows a cross-section of an acceptor sheet of the invention in which the support is coated on one side with a dye mordanting layer, a vehicle-absorbing layer, and an overcoat layer.

FIG. 3 shows still another embodiment 30 of the invention wherein an image-forming layer 32 containing the high molecular weight amino compound mordant and a portion of the water-absorbing polymer is coated on support 12. Coated over layer 32 is transparent, water-absorbing polymer layer 34 which is substantially free of said mordant. The transparent water-absorbing polymer has no affinity for the ionic dyestuffs of the ink jet inks, which are captured completely and irreversibly by the mordant material in layer 32. This embodiment is suitable for outdoor display and for other uses when a high degree of protection for the image is desired, since the image-forming layer is well below the upper surface of the film. If desired, the embodiment of FIG. 3 can be further protected by a transparent polymeric overcoat 36.

Figure 4:
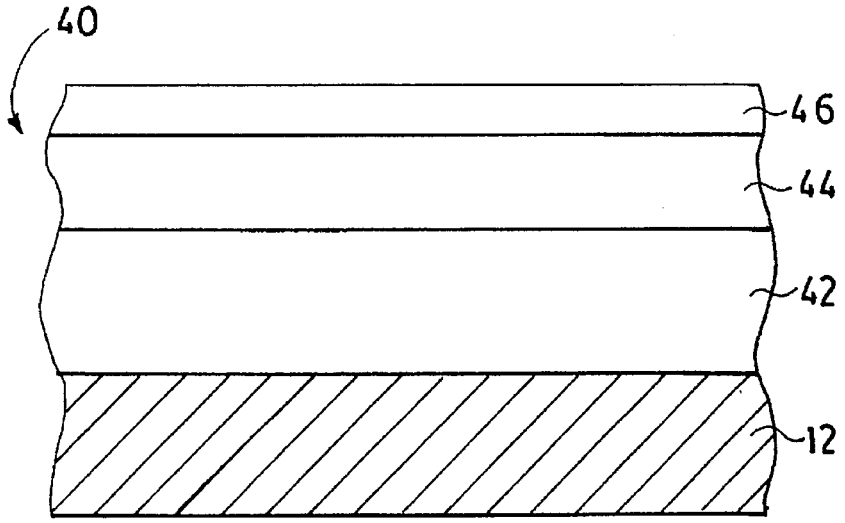
FIG. 4 shows a cross-section of another plural layer embodiment of the acceptor sheet of the invention.

FIG. 4 shows a further embodiment 40 of the invention wherein image-forming layer 44 is coated over water wicking layer 42. As in embodiment 30, a protective overcoat 46 may or may not be present. Embodiment 40 can be useful when the maximum possible image definition is desired, since the dyestuffs are captured near to the upper surface of the acceptor material before perceptible diffusion spreading of the imaging dots can occur.

When the water-absorbing polymer is a hardened polymer, the particular hardening agent to be used can vary according to the composition of the polymer to be hardened. A preferred hardener for gelatin is dimethyl hydantoin. Various aldehydes, e.g., formaldehyde, glutaraldehyde and succinaldehyde are also useful. Other useful gelatin hardeners are disclosed, in "The Theory of the Photographic Process," Macmillan Publishing Co., Inc., New York, Fourth Edition, T. H. James, Editor; (see Chapter III, pages 77–87, by Burness and Pouradier, entitled "The Hardening of Gelatin and Emulsions"), the disclosure of which is incorporated herein by reference. Hardening agents for other polymers include, for example, the trifunctional aziridine, trimethylol propane tris (β-aziridinyl) propionate, known as XAMA-7 which is available from Sanncor Co. The amount of hardening agent in the composition of the invention can vary over a considerable image. In general, however, the amount should be sufficient to render the polymer insoluble in water at temperatures below 50° C. while retaining water solubility at temperatures above about 50° C., so that the ink-accepting composition of the invention can be coated on a support from an aqueous medium. In general, the desired amount of hardening agent can be determined by the equilibrium viscosity achieved by adding the agent. Sufficient hardening agent is added to increase the viscosity of the polymer at a given solids concentration by about 10 to 200% but not so much as to render it uncoatable. Preferred weight ratios of hardening agent to gelatin are in the range from about 1:1 to 1:10 although other ratios are also suitable. Other hardenable polymers can be hardened with similar ratios of hardening agent.

To prepare the composition of the invention for coating as a single layer on a support, preferably, the matrix polymer, the hardening agent, the water soluble mordant and water are mixed together in a vessel with stirring and moderate heating. If desired, the polymer and hardener can be mixed before adding the mordant but it can be advantageous to add the mordant before the polymer is hardened. This can have the effect of grafting the soluble mordant compound to the wicking polymer.

Other desirable components of the coating composition can be added before or after hardening the matrix polymer. These include a coating aid and polymeric beads as referred to above. These bead materials are unexpectedly useful in improving the feeding and drying properties of the acceptor sheets of the invention without substantially impairing their transparency.

Conventional coating techniques can be used for producing the coated ink acceptor materials of the invention, including, for example, spray, evaporative; bar coating, extrusion die coating, air knife, knife over roll, reverse roll, curtain coating, blade coating and gravure coating of a continuous web of the support material. The coated web is dried in conventional manner e.g., by contact with warm air while passing through a drying chamber. The dried coated web can be wound on a take-up roll and later cut to desired sheet sizes. The total thickness of the dried ink-accepting composition on the support; whether coated as one or a plurality of layers is preferably in the range from about 1 to 25 μm (although a greater thickness can be used) and most preferably is in the range from about 2 to 18 μm. The dried coated web can be wound on a take-up roll and later cut to desired sheet sizes.

The coated amount of water-absorbing polymer must be sufficient to absorb the substantial volume of water that is present in the ink jet ink. In general, an amount of water-absorbing polymer of at least about 2.0 grams per square meter on the support will adequately absorb the water in the ink jet droplets and will provide a quick-drying material. Likewise, the ink accepting composition must contain a sufficient amount of mordant to bind all of the dyestuff in the ink. In general, the amount of mordant should be at least about 0.2 weight percent and, preferably, at least 5 weight percent, of the amount of dry water-absorbing polymer in the ink accepting composition. The maximum mordant content should not be so high as to impair the desired physical properties of the acceptor material. Preferably, the mordant concentration does not exceed about 30 weight percent based on the weight of the water-absorbing polymer.

The examples which follow illustrate certain specific embodiments of the invention and describe comparative tests with commercially available ink jet acceptor materials.

EXAMPLE 1

A vessel fitted with a mixer and a heater was charged with 48.8 grams of 7.5% suspension of gelatin in water (available as T7188 from K&K Corp.) and 36.6 grams of distilled water. The mixture was stirred and the temperature was raised to 49° C. (120° F.). After 5 minutes of stirring, the viscosity was 23 cps. Then 4.88 grams of a 55% aqueous solution of dimethyl hydantoin (Dantoin hardener, available from Lonza Co.) was added with continued stirring. After 10 minutes, the viscosity had increased to 35 cps, and no further increase was seen. 8.0 grams of 10% poly(4-vinylpyridine) aqueous solution (available from Monomer-Polymer Corp.), pH adjusted to 4.0 with acetic acid, was added with stirring, followed by 0.122 grams of particulate Malogel starch (available from National Starch and Chemical Co.) as a roughening agent and 1.7 grams of 2% aqueous solution of octylphenoxypolyethoxy-ethanol (Triton X-100 available from Union Carbide) as coating aid. The batch was adjusted to pH 8.0 by addition of $NH_4OH$, the temperature was reduced to 38° C. (100° F.), and the resulting thickened solution was ready for coating.

The thickened solution was coated on transparent 3.85-mil poly(ethylene terephthalate) fill (Melanex 6093, available from ICI Ltd.) at a dry coverage of 3 grams per square meter of support, resulting in a glossy, dried ink accepting layer 3 μm thick. When this film was imaged on a Hewlett-Packard 500C DeskJet ink jet printer with a cartridge of Hewlett-Packard ink containing ionic dyes, the individual ink images emerged dry from the printer. A large area black image did not transfer ink to a cotton ball after 45 seconds of drying time. Dot resolution was excellent.

A strip of the imaged film was immersed in water for two minutes, then removed and dried. Reflection dye densities of immersed and non-immersed strips were measured with an X-Rite Densitometer, Model 408. The results of these measurements are listed in Table I and demonstrate the water-fastness of the ink acceptor film of Example 1:

TABLE I

Water-Fastness Test of Example 1 Film

| Dye | Optical Density Before Immersion | Optical Density After Immersion | Density Difference Between Non-Immersed and Immersed Films |
|---|---|---|---|
| Cyan | 1.50 | 1.52 | +0.02 |
| Magenta | 0.87 | 0.87 | 0.00 |
| Yellow | 0.80 | 0.91 | +0.11 |
| Black | 1.70 | 1.71 | +0.01 |

The results recorded in Table I show that immersion of the imaged film of the invention in water caused no density loss, thus indicating that essentially none of the mordanted dye was washed from the film. The increases in density shown for certain of the dyes are believed to have resulted from swelling and dye rearrangement and packing. In comparison, a commercial ink jet acceptor film when printed and subjected to the same water-immersion test showed a magenta dye density loss of −0.77.

Although in Example 1 the pH of the batch was adjusted to 8.0 by adding $NH_4OH$, this adjustment was not required. The aqueous coating composition can be at an alkaline or acidic pH as demonstrated hereinafter. The adjustment to an alkaline pH simply demonstrates that the poly(4-vinylpyridine) need not be protonated to its quaternary ammonium form in order to function as a mordant for anionic dyestuffs.

Light Exposure Testing of Example 1 Film of the Invention and a Commercial Film

The non-immersed Example 1 film of the invention and a commercially available ink jet recording film which were identically imaged in an ink jet printer were exposed to GE F400W fluorescent bulbs at 5,000 lux intensity for 72 hours, at the end of which time they were compared to otherwise identical unexposed strips (ASTM F767-82) of the same imaged films. The reflection densities (indicating dye retention) are shown in Table II for the Example 1 film and in Table III for the commercial film.

TABLE II

Film of the Invention - Optical Density Before and After Light Exposure

| Dye | Film of Example 1 Before Exposure | Film of Example 1 After Exposure | Density Difference Between Unexposed and Exposed Film |
|---|---|---|---|
| Cyan | 1.50 | 1.35 | −.15 |
| Magenta | 0.87 | 0.81 | −.06 |
| Yellow | 0.80 | 0.78 | −.02 |
| Black | 1.70 | 1.56 | −.14 |

TABLE III

Commercial Film - Optical Density Before and After Light Exposure

| Dye | Commercial Film Before Exposure | Commercial Film After Exposure | Density Difference Between Unexposed and Exposed Film |
|---|---|---|---|
| Cyan | 1.50 | 0.91 | −0.59 |
| Magenta | 0.99 | 0.93 | −0.06 |
| Yellow | 0.88 | 0.77 | −0.11 |
| Black | 1.57 | 1.37 | −0.20 |

Comparison of the density differences in Tables II and III shows that the light stability of the imaged film of the invention was substantially improved over that of the commercial film, especially with regard to cyan dye stability.

Figure 5:
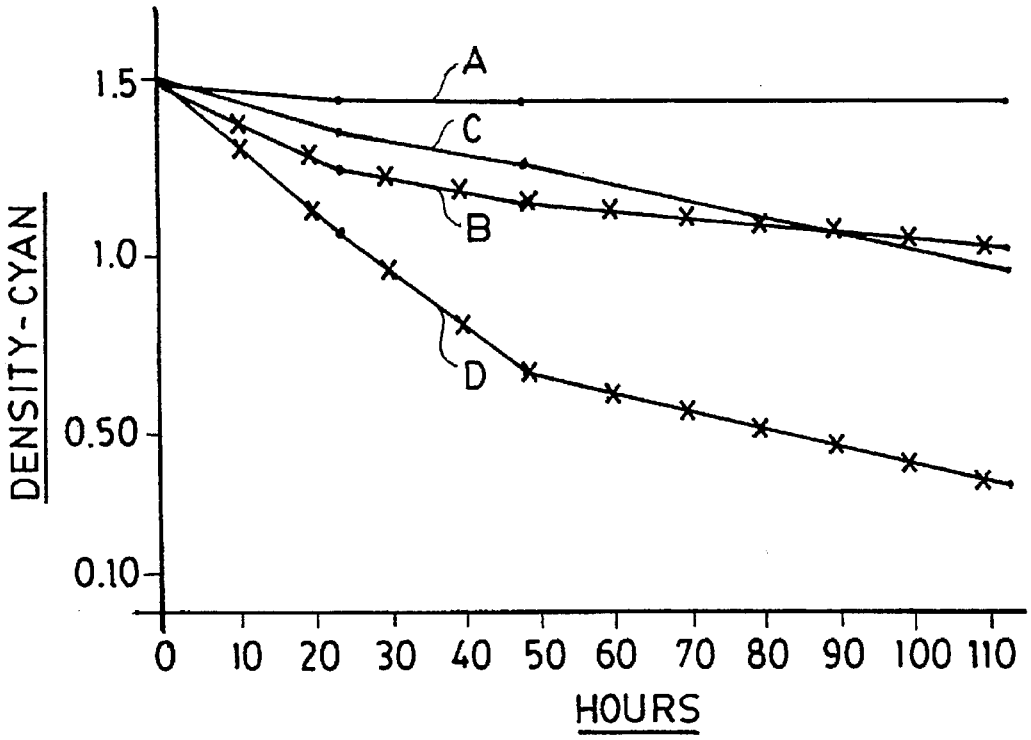
FIG. 5 plots light stability test results for dyes printed on a material of the invention and on a commercially available material.

FIG. 5 of the drawings also illustrates the superior light stability of the Example 1 film of the invention as compared with the commercial film. The cyan dye densities of the two films are plotted in this figure over extended periods of time for high intensity light exposure and for normal room light exposure. Curve A of FIG. 5 shows that the cyan dye density of the film of the invention remained substantially constant over a period of 110 hours of normal room light exposure. In contrast, Curve B shows that the cyan dye density of the commercial film decreased linearly from 1.5 to about 1.1 after 110 hours. Curve C plots the cyan density for the film of the invention after exposure and Curve D plots the cyan density for the commercial film after the same exposure. As Curves C and D illustrate, the commercial film decreased much more sharply in cyan density than did the film of the invention.

The next example describes a product of the invention in which the mordant is a high molecular weight triamine.

EXAMPLE 2

In the same manner as in Example 1, a coating composition having the following composition was prepared:

| | |
|---|---|
| 20.00 g | 10% gelatin |
| 0.30 g | 55% Dantoin hardener |
| 2.50 g | 10% high molecular weight amine (Jeffamine T-403) |
| 0.05 g | 20% Triton X-100 coating aid |
| 0.04 g | dimethylsiloxane particles (GE SR 346) |
| 77.11 g | water |

This aqueous composition was coated on a poly(ethylene terephthalate) film support and dried to yield (a dried layer of approximately 2.0 lb./1000 $ft^2$ and about 9 μm thickness. The resulting ink acceptor material of the invention was printed with colored ink in a thermal ink jet printer and produced image densities as follows: cyan, 1.72; magenta, 1.48; yellow, 1.15; and black, 1.94. A strip of the printed film was subjected to the 2 minute water immersion test. Magenta density before the water test was 1.48 and after the test was 1.42. The density change of only—0.06 indicates excellent water resistance and marked superiority over the commercial film referred to in Example 1, which suffered a magenta density change of –0.77 in the water-immersion test.

EXAMPLE 3

An ink acceptor material of the invention was prepared and tested as in Example 2. The composition differed only in that the mordant compound was the high molecular weight triamine, Jeffamine T-5000. Densities of dyes in a printed sample of the film were: cyan, 1.74; magenta, 1.54; yellow, 1.21; and black 2.56. A sample subjected to the water dip test had a magenta density before immersion of 1.59 and after immersion 1.65. The density difference of +0.06 shows that essentially no dye was lost during water immersion.

The following example illustrates the successful preparation of a film of the invention containing the same mordant as in Example 1, i.e., poly(4-vinylpyridene) but having a lower mordant content and having friction reducing beads in the coating.

EXAMPLE 4

Using the procedure of Example 1, a coating composition of the following components was prepared:

| | |
|---|---|
| 20.0 g | 10% gelatin |
| 0.37 g | 55% Dantoin hardening agent |
| 0.25 g | 10% poly(4-vinyl pyridine) mordant |
| 0.60 g | 2% Triton TX-100 coating aid |
| 0.05 g | Soken MR-13G poly(methylmethacrylate) beads, 9–13 μm diameter |
| 78.73 g | Water |

This composition of the invention was coated on polyester film support and subjected to high intensity fluorescent light exposure as in Example 1. Table IV provides a comparison of the dye densities of the film of the invention and of a commercial ink jet acceptor film after comparable exposure.

TABLE IV

Light Fade Comparison of Example 4 Film and Commercial Film

| Dye | Film of Example 4 Before Exposure | Film of Example 4 After Exposure | Density Difference Between Unexposed and Exposed Film of Example 4 | Density Difference Between Unexposed and Exposed Commercial Film |
|---|---|---|---|---|
| Cyan | 1.46 | 1.31 | –0.15 | –0.59 |
| Magenta | 0.92 | 0.86 | –0.06 | –0.06 |
| Yellow | 0.83 | 0.75 | –0.08 | –0.11 |
| Black | 1.31 | 1.22 | –0.09 | –0.20 |

The results recorded in Table IV show markedly less density loss for cyan and significantly less density loss for yellow and black in the film of the invention than for the commercial film after high intensity light exposure.

The Example 4 film of the invention and the commercial film were also subjected to the 2-minute water immersion test as previously described. The magenta density loss for the commercial film was 0.77, but only 0.02 for the film of the invention. Thus, even with the lower mordant content, the film of the invention provided superior light stability and water resistance.

The next example describes the preparation and testing of a film of the invention in which the water soluble mordant and the water absorbing material were coated in separate layers.

EXAMPLE 5

In this example the mordant was poly(4-vinylpyridine) and the water absorbing material was hardened gelatin. To prepare the ink acceptor material of the invention the following solutions were formed in the manner described in Example 1:

| Solution A | |
|---|---|
| 40.0 grams | 10% gelatin |
| 40.0 grams | 10% poly(4-vinylpyridine) solution |
| 0.4 gram | 55% Dantoin hardening agent |
| 0.1 gram | 2% Triton TX-100 coating aid |
| 19.5 grams | Water |
| Solution B | |
| 98.77 grams | 10% gelatin |
| 0.99 grams | 55% Dantoin hardening agent |
| 0.15 grams | poly(dimethyl siloxane) particles, 7–12 μm diameter (GE SR346 from General Electric) |

Solution A was coated as a base coat at a concentration of 0.5 lbs./1000 sq. ft. on a polyester film support. After drying the base coat, solution B was coated over it at a concentration of 1.0 lb./1000 sq. ft. to form the top coat.

The resulting two-layer film was imaged with ink jet colored ink in a thermal ink jet printer and the resulting image was compared with the commercial film for light stability and water-immersion stability as previously described. For the film of the invention, water stability was superior to that of the commercial film as in the other examples. Results of the light stability tests, in terms of reflection densities of the individual dyes, are listed in Table V below.

TABLE V

Light Stability of the Two-Layer Film in Comparison with Commercial Film

| Dye | Film of Example 5 Before Exposure | Film of Example 5 After Exposure | Density Difference Between Unexposed and Exposed Film of Example 5 | Density Difference Between Unexposed and Exposed Commercial Film |
|---|---|---|---|---|
| Cyan | 1.87 | 1.67 | −0.20 | −0.59 |
| Magenta | 1.15 | 1.15 | 0 | −0.06 |
| Yellow | 1.08 | 0.98 | −0.10 | −0.11 |
| Black | 1.48 | 1.33 | −0.15 | −0.20 |

The invention has been described in detail with particular reference to preferred embodiments thereof, but it will be understood that variations and modifications can be effected within the spirit and scope of the invention.

I claim:

1. An acceptor material for inks containing anionic dyestuffs and an aqueous vehicle, said material comprising:

a support, and coated on one side of said support a water-soluble high molecular weight non-ionic amino compound which, when admixed in excess with said anionic dyestuffs in aqueous solution at room temperature, forms a water-insoluble precipitate and a clear supernatant liquid, said amino compound being dispersed in a matrix of a water-absorbing polymer which is non-reactive with and permeable by said anionic dyestuffs, said dispersed amino compound reacting with said anionic dyestuffs, thereby immobilizing said anionic dyestuffs in said matrix, said dispersed amino compound being selected from the group consisting of poly-(4-vinylpyridine) and a compound having the formula

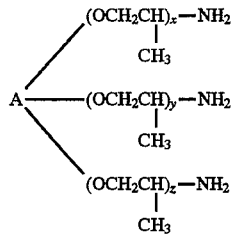

wherein A is the hydrocarbon residue of an aliphatic triol having up to about 12 carbon atoms, x, y, and z are each positive integers, and x+y+z=3 to about 85.

2. An acceptor material of claim 1 wherein said amino compound is dispersed in said polymer in a single layer.

3. An acceptor material of claim 1, which comprises a layer containing said amino compound and another layer containing said polymer but not said amino compound.

4. An acceptor material of claim 1 wherein said polymer is gelatin which has been pre-hardened by chemical reaction with a hardening agent prior to coating.

5. A material of claim 1 wherein said aliphatic triol is trimethylolpropane and x+y+z equals 5 to 6.

6. An acceptor material of claim 1 wherein said aliphatic triol is glycerine and x+y+z equals approximately 50.

7. An acceptor material of claim 1 wherein said aliphatic triol is glycerine and x+y+z equals approximately 85.

8. An acceptor material of claim 1 which, when contacted by said inks, mordants said dyestuff preferentially onto surface sites of said amino compound while permitting said aqueous vehicle to diffuse throughout said polymer composition, whereby the highest concentration of mordanted dyestuff is near the surface of said material.

9. An acceptor material of claim 1 wherein said support is paper or a transparent or opaque plastic film.

10. An acceptor material of claim 1 further comprising beads of cross-linked poly(methylmethacrylate) or of poly (dimethylsiloxane), which beads improve feeding and drying properties of the material without impairing transparency.

11. The acceptor material of claim 1 wherein said amino compound has a number-average molecular weight of at least about 400.

12. A process for forming an ink jet image on an acceptor material from an ink containing an anionic dyestuff and an aqueous vehicle, said process comprising:

applying the ink to a surface of the acceptor material, said acceptor material comprising:

a support, and coated on one side of said support a water-soluble, high molecular weight, non-ionic amino compound that, when admixed in excess with said anionic dyestuff in aqueous solution at room temperature, forms a water-insoluble precipitate and a clear supernatant liquid, said amino compound being dispersed in a matrix of a water-absorbing polymer that is non-reactive with and permeable by said anionic dyestuff, said dispersed amino compound reacting with said anionic dyestuff, thereby immobilizing said anionic dyestuff in said matrix, said dispersed amino compound being selected from the group consisting of poly-(4-vinylpyridine) and a compound having the formula

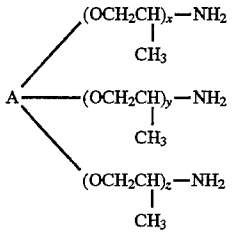

wherein A is the hydrocarbon residue of an aliphatic triol having up to about 12 carbon atoms, x, y, and z are each positive integers, and x+y+z=3 to about 85.

13. The process of claim 12 wherein said amino compound has a number-average molecular weight of at least about 400.

14. An acceptor material for ink jet ink containing at least one water-soluble anionic dye and an aqueous vehicle, said material comprising a support and coated on said support an ink-accepting composition comprising a chemically hardened gelatin matrix which is water-insoluble but water swellable and a water-soluble mordant distributed throughout said gelatin matrix, said mordant being a non-ionic amino compound having a number-average molecular weight of at least 400 which, when mixed in excess in an aqueous solution with said anionic dye at room temperature, forms a water-insoluble precipitate and a clear supernatant liquid, said hardened gelatin being a water management material which absorbs the aqueous vehicle of said ink and has substantially no affinity for said dye and said amino compound being a dye management material which forms a substantially immobile coacervate when contacted with said anionic dye, thereby immobilizing said anionic dye in said matrix, said amino compound selected from the group consisting of poly-(4-vinylpyridine) and a compound having the formula

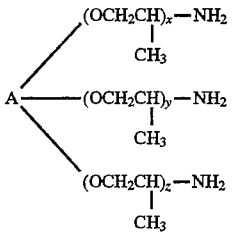

wherein A is the hydrocarbon residue of an aliphatic triol having up to about 12 carbon atoms, x, y, and z are each positive integers, and x+y+z=3 to about 85.

15. An imaged ink jet acceptor sheet which comprises a support and, on said support, a layer containing a water absorbing polymer matrix and, dispersed therein, a water insoluble coacervate of a water soluble high molecular weight non-ionic amino compound and an immobilized water soluble anionic dye compound, said amino compound being a heterocyclic or an aliphatic amino compound selected from the group consisting of poly-(4-vinylpyridine) and a compound having the formula

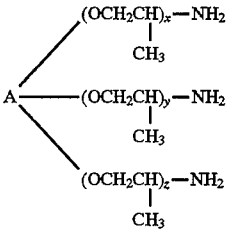

wherein A is the hydrocarbon residue of an aliphatic triol having up to about 12 carbon atoms, x, y, and z are each positive integers, and x+y+z=3 to 85.

16. The imaged ink acceptor sheet of claim 15 wherein said amino compound has a number-average molecular weight of at least about 400.

* * * * *